US005797797A

United States Patent [19]

Parsons

[11] Patent Number: 5,797,797

[45] Date of Patent: Aug. 25, 1998

[54] LATERAL SUPPORT BUTTON SPRING FOR EXPANDABLE BATONS

[75] Inventor: Kevin L. Parsons, Appleton, Wis.

[73] Assignee: Armament Systems and Procedures, Inc., Appleton, Wis.

[21] Appl. No.: 639,938

[22] Filed: Apr. 19, 1996

[51] Int. Cl.[6] ..... F41B 15/02

[52] U.S. Cl. ..... 463/47.7; 135/75; 285/319

[58] Field of Search ..... 135/37, 38, 39, 135/69, 75, 76; 463/47.2, 47.7; 285/298, 302, 303, 319

[56] References Cited

U.S. PATENT DOCUMENTS 838,519 12/1906 Bremer ..... 285/319

5,149,092 9/1992 Parsons ..... 135/75

*Primary Examiner*—William M. Pierce

*Attorney, Agent, or Firm*—McDonnell, Boehnon Hulbert & Berghoff

[57] ABSTRACT

These and other advantages are achieved through the flanged, flat spring of the present invention. The spring comprises a single, C-shaped leaf element formed of a substantially flat base having an aperture therein for receipt of a detent button, a pair of flat spring legs radiating outwardly from the base in a direction generally opposite the direction of the projecting detent button, a pair of upturned feet attached to the legs, and a flange extending downward from each side of the base. The flanges increases the effective thickness of the spring, which results in a decreased bending stress and hence, a longer fatigue life. Therefore, the flanges increases the effective thickness of the spring without increasing the actual material thickness of the spring. In addition, the upturned ends of the legs provide a surface which can be more easily grasped to manipulate the spring within a baton tube.

13 Claims, 1 Drawing Sheet

LATERAL SUPPORT BUTTON SPRING FOR EXPANDABLE BATONS

BACKGROUND OF INVENTION

1. Field of Invention

This invention relates generally to police batons or night sticks and is specifically directed to expandable batons locked together using a detent mechanism.

2. Description of the Prior Art

Extendable police batons or night sticks are known in the art. Generally, the batons are comprised of a plurality of members which telescope relative to one another. Such batons are designed to be of a reduced or collapsible length when in retracted position, permitting a police officer to more easily carry or stow the baton than is possible with one-piece wand batons. Under certain circumstances, it is desirable to expand the baton to an extended length to facilitate certain police activities such as, by way of example, warding off an attacker or other person without having to approach too closely to the person. One method of securing the telescoping members of batons such as this is by way of detent mechanism comprised of a spring and button. Typically, the spring is attached to or disposed within a first telescoping member of the baton and urges the button into a notch provided on a second telescoping member of the baton such that the two members are secured relative to one another.

Examples of telescoping batons provided with detent mechanisms are replete in the art. In U.S. Pat. No. 27,335 issued to J. L. Rowe on Feb. 28, 1860, an extendable baton having a solid core is disclosed. The baton is provided with a hollow tubular outer shell which may be extended and retracted along the longitudinal axis of the hollow cylindrical core to extend or collapse the baton. An elongated leaf spring is provided on the sleeve and includes a detent button which engages an annular stop provided on the core for holding the baton in the retracted position.

In U.S. Pat. No. 3,371,930 issued to Y. Shiga on Mar. 5, 1968, a telescoping baton comprising a plurality of nested, hollow tubular members is disclosed. The tubular members are moveable between a fully nested, retracted position and a fully extended, expanded position. Detent buttons are provided on the telescoping members and project outwardly beyond the end wall of the adjacent member when the baton is extended for locking the baton in the fully expanded position. The baton members include rings at their abutting ends to define positive stops. Shiga also teaches an inwardly projecting detent-type lock which protrudes outwardly from the baton and is spring-loaded and self-actuated to permit collapse of the telescoping member.

In U.S. Pat. No. 5,149,092 issued to K. Parsons on Sep. 22, 1992, a telescoping extendible baton is comprised of a plurality of nested, telescoping members. A detent locking mechanism is disposed within the telescoping member and extends outward through the telescoping member to provide an abutment stop against which the end of the outer, adjacent telescoping member rests. The push button of the detent mechanism is dimensioned to always stay at or below the surface of the abutment member to minimize likelihood of inadvertent depression of the detent, rendering it difficult for an assailant to grasp the baton and collapse it as it is being used by an authorized party. The push button is attached to a standard "C-shaped" flat spring having an enlarged flat base which extends generally in the direction parallel to the longitudinal axis of the baton. Specifically, the push button is mounted in an aperture provided in the surface of the flat base. The opposite ends of the legs of the flat spring are upturned at their outer ends to minimize the tendency of the legs to snag or engage the interior surface of the telescoping member s the detent is depressed and the baton is retracted. This also assures that both legs of the spring move in a uniform manner, providing a uniform biasing force against the detent.

Flat springs such as those described above are generally characterized by a short fatigue life due to the combination of high stress relative to the spring design, frequency of deflection, and the presence of bends and holes in the spring. For example, one common point of fatigue in such springs is in the surface of a spring where the push button aperture is located. The aperture functions as a point of high stress concentration, especially since such an aperture is typically provided in a spring having a narrow width relative to the diameter of the aperture. In other words, by removing a comparatively large amount of material in the area of the aperture, there is less spring surface area over which a bending force can be distributed. Furthermore, the dimensions of the spring, especially width, are limited by the inner diameter of the telescoping members. In most cases, the inner diameter of the telescoping member is one-half inch or less. Since the push button must be large enough to easily operate, the diameter of the spring's aperture for attachment of the push button relative to the spring's width is large. In most cases, therefore, failure of the prior art springs occurs adjacent this aperture, either inelastically deforming or breaking. In any case, such spring failure can cause the nested sections of a baton to prematurely collapse.

Another undesirable feature of the expandable baton springs of the prior art is the difficulty with which the springs can be retrieved from within a baton member. Specifically, the small inner diameter of a baton member inhibits the ease of removal of the springs. This is especially true without the use of specialized tools.

Therefore, it is an object of this invention to provide an expandable baton leaf spring with a prolonged fatigue life. The fatigue life should be increased without the need to alter the dimensions of the spring, i.e., width, aperture size, length, etc. It is another object of this invention to provide and expandable baton leaf spring which easily can be retrieved from the narrow diameter of a baton member.

SUMMARY OF THE INVENTION

These and other advantages are achieved through the flanged, flat spring of the present invention. The spring comprises a single, C-shaped leaf element formed of a substantially flat base having an aperture therein for receipt of a detent button, a pair of flat spring legs radiating outwardly from the base in a direction generally opposite the direction of the projecting detent button, a pair of upturned feet attached to the legs, and a flange extending downward from each side of the base. The flanges increases the effective thickness of the spring, which results in a decreased bending stress and hence, a longer fatigue life. Therefore, the flanges increases the effective thickness of the spring without increasing the actual material thickness of the spring. In addition, the upturned ends of the legs provide a surface which can be more easily grasped to manipulate the spring within a baton tube.

DETAILED DESCRIPTION OF THE PREFERRED EMBODIMENTS

Figures 1, 2, 3, 4, 5, 6:
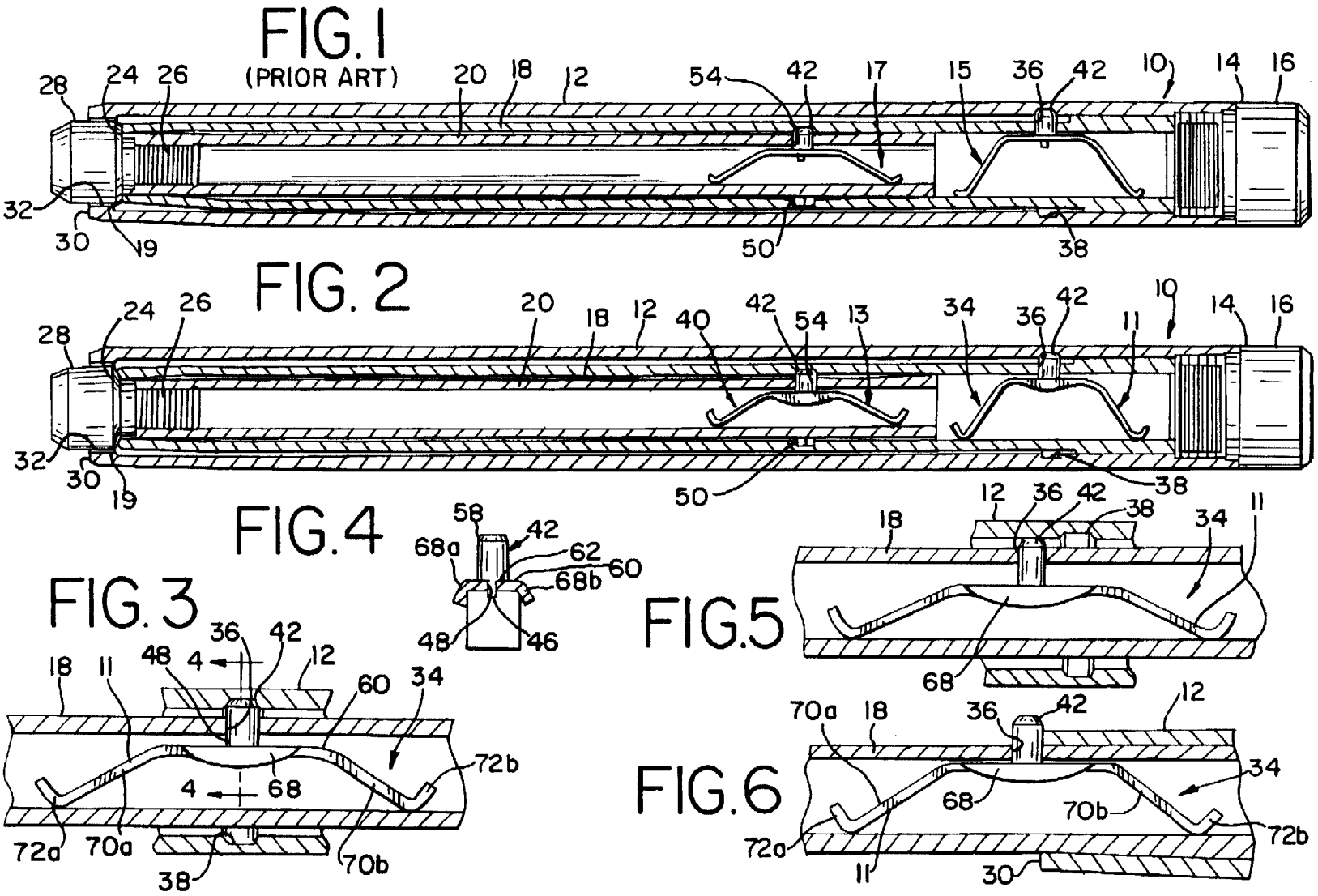
FIG. 1 (PRIOR ART)
FIG. 1 is a side elevation view, partially in section, of an expandable baton containing flat springs of the prior art.
FIG. 2 is a side elevation view, partially in section, of an expandable baton containing flat springs of the present invention.
FIG. 3 is an enlarged fragmentary view, in section, showing the baton and spring in the retracted position.
FIG. 4 is a sectional end view of the spring of FIG. 3.
FIG. 5 is an enlarged fragmentary view, in section, showing the baton and spring in an intermediate position.
FIG. 6 is an enlarged fragmentary view, in section, showing the baton and spring in the expanded position.

The preferred embodiment of flat springs 11, 13, in accordance with the with the present invention, are disposed in an expandable baton 10 as shown in FIG. 2. In contrast, FIG. 1 illustrates flat springs 15, 17 of the prior art disposed in expandable baton 10. In the detailed description of this invention, like numerals are employed to designate like parts throughout the same.

With reference to FIGS. 1 and 2, expandable baton 10 comprises an elongated tube 12 defining the barrel or handle of the baton and having a first open end 14 for receiving a threaded endcap 16. A first telescoping member 18 and a second telescoping member 20 are adapted to be inserted in barrel 12 through the open end 22 prior to securing endcap 16 therein. First telescoping member 18 comprises an elongated hollow tube which slides within tube 12. Likewise, second telescoping member 20 comprises an elongated hollow tube which slides within tube 18. Second telescoping member 20 has an open outer end 24 which is internally tapped as at 26 for receiving a threaded tip 28. The outer end 30 of barrel 12 includes a central through opening 32 large enough to accommodate the tip 28 and the cylindrical outside perimeter wall of first telescoping member 18. A detent mechanism 34 is disposed in first telescoping member 18 adjacent a clearance hole 36 extending through member 18. An annular groove 38 is provided around the interior circumference of barrel 12. In the retracted position of baton 10, illustrated in FIG. 2, annular groove 38 is aligned with clearance hole 36 and detent mechanism 34. A similar detent mechanism 40 and arrangement is also provided between first and second telescoping members 18 and 20.

With reference to FIG. 3, detent mechanism 34 includes a detent button 42 which passes through the clearance hole 36 in first telescoping member 18. Detent button 42 is mounted on a substantially C-shaped flat spring 11 in any standard manner, and is normally biased outward from the outer side wall of first telescoping member 18 and toward barrel 12 (see FIG. 5). In one preferred embodiment, detent button 42 is provided with a pin 46 which mounts in aperture 48 extending through spring 11 (see FIG. 4). As mentioned above, first telescoping member 18 also includes an annular groove 50 which is adapted for receiving detent button 42 which passes through the clearance hole 54 in second telescoping member 20. Detent button 42 is likewise suitably mounted on a substantially C-shaped flat spring 13 which is disposed in the hollow interior of the second telescoping member for normally urging the detent button 42 outwardly from the outer side wall of second telescoping member 20 into the wall of first telescoping member 18.

When baton 10 is in the retracted position of FIG. 2, the detent buttons 42 are biased toward and project into the annular grooves 38, 50, respectively, for maintaining baton 10 in the nested position. The force of the springs 11, 13 is sufficient to hold baton 10 in the nested position during normal conditions.

As shown in FIG. 4, each of the detent buttons 42 includes a radius at its outer end 58. The rounded outer end 58 of button 42 permits the button to be disengaged from the respective annular groove 38, 50 when a sufficient axial force is applied to the telescoping members of baton 10 either by providing a fast swinging or jerking motion of baton 10 to release it to the extended position or by first pulling on the outer tip 28 and, after second telescoping member 20 is fully extended, pulling on second telescoping member 20 to release buttons 42 from annular grooves 38, 50.

When baton 10 is fully extended and the two telescoping members 18, 20 are extended outward axially from barrel 12, detent buttons 42 are disposed just beyond and adjacent to the outer ends 30, 19 of the respective members, whereby detent buttons 42 are urged beyond the outer walls of the telescoping members and into abutting relationship with the outer ends to serve as a positive stop for precluding accidental retraction or collapse of the baton.

In the preferred embodiment of the invention, detent buttons 42 are approximately ⅛ of an inch in diameter and extend outwardly from the respective outer side walls of the telescoping members to a distance not exceeding the raised abutting outer side wall of the adjacent telescoping member or barrel. This precludes any attempt by the assailant to grab the perimeter of the baton and retract the detent button, and thereby causing collapse of the baton during use. Detent buttons 42 provide the sole locking means for locking baton 10 against retraction, wherein the non-locking abutment ends 30, 19 provide the positive stop for maintaining baton 10 in its fully extended position. Baton 10 may be retracted to its nested, closed position (FIGS. 2 and 3) by retracting the detent button 42 to a position at or beneath the outer surface of the side wall of telescoping member 18, permitting detent button 42 to pass through the central bore 32 in barrel 12 (FIG. 5) such that first telescoping member 18 can be fully withdrawn into barrel 12. Second telescoping member 20 is similarly retracted into first telescoping member 18.

Those skilled in the art will understand that bending stress ($S_b$) can be represented in leaf springs by the following equation:

$$S_b=(3*P*L)/(2*b*t^2) \qquad \text{Equation 1}$$

wherein P=load

L=active length subject to deflection b=widest width of spring t=effective thickness of spring If all variables except spring thickness (t) are maintained as constants, Equation 1 can be rewritten as follows:

$$S_b=C*t^{-2} \qquad \text{Equation 2}$$

wherein C =constants Therefore, bending stress $S_b$ is inversely related to the square of the thickness of the spring, such that an increase in the spring thickness will decrease bending stress. However, it is an object of this invention to increase the fatigue life without altering the thickness of the spring. This is achieved through the incorporation of side flanges as described below.

As shown in FIGS. 3 and 4, in the preferred embodiment of the invention, spring 11 comprises a substantially flat base portion 60 through which button 42 is inserted. Typically button 42 includes an enlarged head area 62 and pin 46. Spring base 60 includes aperture 48 which is adapted to receive pin 46 for maintaining button 42 in the spring.

Base 60 is also provided with a flange **68*a*, 68*b* which projects downward from the side edges of base 60 and increases the effective thickness (t), and thus the bending stress ($S_b$), of spring 11. In other words, for purposes of Equations 1 and 2, flange 68 permits the effective thickness to be increased without increasing the actual material thickness of spring 11. Those skilled in the art will understand that both the width of flange 68 and angle between flange 68 and base 60 impact the effective width of spring 11. In one preferred embodiment, the width of flange 68 is at least the radius of aperture 48 and the angle between the intersection of flange 68 and base 60 is 60°. Therefore, flange 68 is used to reincorporate into spring 11 the quantity of material removed from spring 11 to create aperture 48. Furthermore, by decreasing this angle between 180° and 90°, the effective thickness of spring 11 is increased. The effective thickness is also dependent on the width of flange 68. The larger the width of flange 68, the greater the effective thickness of spring 11. An increase in the effective thickness (t) of base 60 through the presence of flanges 68***a* and 68*b* reduces the bending stress ($S_b$) of spring 11 according to Equations 1 and 2. Although flange 68 is shown as elliptical in shape, those skilled in the art will understand that flange 68 can have any shape as long as the bending stress ($S_b$) of spring 11 is reduced in the above described manner. Furthermore, although not intended to limit the scope of the claims, preferably, the length of flange 68 is at least as long as the diameter of aperture 48 such that the concentration of stress in base 60 about aperture 48 is dispersed along the length of flange 68.

A pair of flat spring legs 70*a*, 70*b* radiate outwardly from base 60 in a direction generally opposite the direction of the projecting detent button 42. Legs 70 are angled relative to the axis of detent button 42 to provide good spring force when the spring is mounted in the interior of the baton as shown in FIG. 2. In the preferred embodiment, the tips or outer ends 72*a*, 72*b* of spring legs 70 are each provided with an upwardly turned radius to assure that the tips of the spring legs do not engage and gouge the interior surface of the hollow telescoping members. This permits the spring to expand and contract equally by sliding along the interior surface of the telescoping members, assuring that the spring maintains consistent resiliency after repeated uses. Flat base 60 assures that button 42 will not become cocked or skewed relative to barrel 12 or first telescoping member 18 when a substantially axial force is applied against the outer end of the extended baton. This provides additional assurance against premature retraction of the detent buttons 42 and reduces the likelihood of unanticipated collapse and retraction of baton 10. In one preferred embodiment, each tip 72 of spring leg 70 is angled 75° relative to the axis of the spring leg. The upturned spring ends 72 also facilitate in disassembly of baton 10 when required. Specifically, button 42 may be withdrawn below clearance hole 36 by an appropriate push rod (not shown) and upturned end 72 may be engaged, permitting axial withdrawal of spring 11.

During operation, a load applied to button 42 of spring 11 (see FIG. 2) will result in an bending stress whose magnitude is dependent upon the width and angle of flange 68. The presence of flange 68 increases the effective thickness of spring 11. Since the bending stress of spring 11 is inversely proportional to the square of its effective thickness, this increase in the effective thickness will decrease the bending stress of spring 11. As such, the fatigue life of spring 11 will be increased. In contrast, the prior art spring 15 of FIG. 1, having the same dimensions and physical properties as spring 11 of the current invention, will fatigue at a faster rate due to the smaller effective thickness of the prior art spring. Furthermore, the upturned ends of the legs of spring 11 and the increased length of the upturned portions will allow the spring to be more easily grasped and manipulated during maintenance of baton 10.

While certain features and embodiments of the invention have been described herein, it will be readily understood that the invention includes all modifications and enhancements within the scope and spirit of the following claims.

What is claimed is:

1. A detent spring for use in expandable batons, said spring comprising:

a. a base having a length and side edges, a first end and a second end;

b. first and second flanges attached to said side edges, each flange having a width and a length;

c. a first leg extending at an angle from said first end;

d. a second leg extending at an angle from said second end; and e. a detent button supported by the base.

2. The spring of claim 1 further comprising at least one arcuate foot attached to one of said legs, said foot having an upwardly turned tip, the tip having a length and a radius and extending at an angle relative to the leg to which said tip is attached.

3. The spring of claim 2 wherein the angle of said upwardly turned tip relative the leg to which said tip is attached is less than 90°.

4. The spring of claim 2 wherein the length of the upwardly turned tip of said foot is at least as large as the radius of said upwardly turned tip.

5. The spring of claim 1 wherein each flange is angled away from said base.

6. The spring of claim 5, wherein said angle is less than 90°.

7. The spring of claim 1, wherein the length of each flange is as long as the said base.

8. The spring of claim 1, wherein an aperture having a radius is defined within said base.

9. The spring of claim 8, wherein the width of each flange is at least the radius of said aperture.

10. The spring of claim 1 wherein each flange is parabola shaped.

11. A detent spring for use in expandable batons, said spring comprising:

a. a base having first and second side edges, first and second ends and an aperture having a radius and a diameter, and extending through said base;

b. a detent button supported by the base;

c. first and second flanges attached to said side edges and extending downward at an angle from said side edges, each flange having a width and a length, wherein the length of said first and second flanges is at least as long as the diameter of said aperture;

d. first and second legs extending downward at an angle from said first and second ends; and e. wherein each leg is attached to an arcuate foot having an upwardly turned tip and extending at an angle relative to the leg to which said tip is attached, the angle of said tip relative to the leg to which said tip is attached being less than 90°.

12. The detent spring of claim 11, wherein said button is provided with a pin for engaging the aperture of said base.

13. The detent spring of claim 11, wherein the width of each of said flanges is at least the radius of said aperture.

* * * * *